US010947740B2

(12) United States Patent
Sighinolfi

(10) Patent No.: US 10,947,740 B2
(45) Date of Patent: Mar. 16, 2021

(54) LEVELLING SPACER DEVICE

(71) Applicant: RAIMONDI S.P.A., Modena (IT)

(72) Inventor: Riccardo Sighinolfi, Rubiera (IT)

(73) Assignee: RAIMONDI S.P.A., Modena (IT)

( * ) Notice: Subject to any disclaimer, the term of this patent is extended or adjusted under 35 U.S.C. 154(b) by 0 days.

(21) Appl. No.: 16/444,613

(22) Filed: Jun. 18, 2019

(65) Prior Publication Data

US 2019/0383027 A1 Dec. 19, 2019

(30) Foreign Application Priority Data

Jun. 19, 2018 (IT) ..... 102018000006440

(51) Int. Cl.
*E04B 2/00* (2006.01)
*E04F 15/02* (2006.01)
*E04F 21/00* (2006.01)

(52) U.S. Cl.
CPC .... *E04F 15/02022* (2013.01); *E04F 21/0092* (2013.01)

(58) Field of Classification Search
CPC . E04F 15/02022; E04F 21/0092; E04F 21/22; E04F 21/1877; E04F 21/20; E04F 13/0892
USPC ..... 52/126.1, 98, 126.6, 126.5, 747.11, 52/749.11
See application file for complete search history.

(56) References Cited

U.S. PATENT DOCUMENTS 4,397,125 A * 8/1983 Gussler, Jr. ..... E04F 21/0092 52/127.3
8,079,199 B1 * 12/2011 Kufner ..... E04F 13/0892 33/526
8,429,879 B1 * 4/2013 Hoffman ..... E04F 21/0092 52/747.11
8,671,628 B2 * 3/2014 Sighinolfi ..... E04F 21/0092 52/126.1
8,800,246 B2 * 8/2014 Gorton ..... E04F 21/0092 52/747.11
8,887,475 B2 * 11/2014 Ghelfi ..... E04F 21/0092 52/749.11
9,322,185 B1 4/2016 Russo
9,447,590 B2 * 9/2016 Sighinolfi ..... E04F 21/0092
9,534,403 B2 * 1/2017 Biec ..... E04F 21/0092
(Continued)

FOREIGN PATENT DOCUMENTS

WO 2011121476 A1 10/2011

*Primary Examiner* — Chi Q Nguyen
(74) *Attorney, Agent, or Firm* — Browdy and Neimark, PLLC

(57) ABSTRACT

A levelling spacer device for the laying of sheet-shaped products for coating surfaces, including a base positionable posteriorly to a laying surface of at least two sheet-shaped products arranged adjacent and side by side relative to a side-by-side direction, a separator element which rises perpendicularly from the base and is configured to slip between facing lateral sides of the two sheet-shaped products placed side by side, a pusher element adapted to cooperate with the separator element, and a plate provided with at least one through opening configured to be inserted onto the separator element, wherein the plate is configured to be interposed between the pusher element and the base and includes a first flat surface facing the base wherefrom at least one lamella is projecting which is configured to slip between a lateral side of a sheet-shaped product and the separator element.

12 Claims, 9 Drawing Sheets

(56) References Cited

U.S. PATENT DOCUMENTS

| | | | | |
|---|---|---|---|---|
| 9,970,203 | B1 * | 5/2018 | Abidov | E04F 21/0092 |
| 10,465,394 | B2 * | 11/2019 | Sighinolfi | E04F 21/0092 |
| 10,724,254 | B1 * | 7/2020 | Troxell | E04F 21/22 |
| 2010/0263304 | A1 * | 10/2010 | Torrents I Comas | E04F 21/0092 52/126.5 |
| 2010/0287868 | A1 * | 11/2010 | Kufner | E04F 21/0092 52/391 |
| 2014/0116001 | A1 * | 5/2014 | Ghelfi | E04F 21/0092 52/749.11 |
| 2015/0027082 | A1 * | 1/2015 | Hoffman | E04F 21/0092 52/749.11 |
| 2016/0090746 | A1 * | 3/2016 | Sighinolfi | E04F 21/18 33/526 |
| 2016/0186449 | A1 * | 6/2016 | Lee | E04F 21/0092 33/527 |
| 2016/0222679 | A1 * | 8/2016 | Bunch | E04F 21/1844 |
| 2018/0291640 | A1 * | 10/2018 | Sighinolfi | E04F 21/20 |
| 2019/0048599 | A1 * | 2/2019 | Papadatos | E04F 21/20 |
| 2019/0063084 | A1 * | 2/2019 | Bunch | E04F 21/22 |
| 2019/0169863 | A1 * | 6/2019 | Torrents Comas | E04F 13/0892 |
| 2020/0056381 | A1 * | 2/2020 | Castellanos | E04F 21/0092 |
| 2020/0224434 | A1 * | 7/2020 | Troxell | E04F 21/22 |

* cited by examiner 60
610
611
312
63

30
40
54
A
B
20
53
50
52
51
55
P
P2
P1
30
A
M
P3
P3
A
20
P2
P
P1

LEVELLING SPACER DEVICE

TECHNICAL FIELD

The present invention relates to a levelling spacer device for the laying of sheet-like products, such as tiles, slabs of natural stone or the like, for coating surfaces, such as floors and, preferably, wall coverings or the like.

PRIOR ART

In the field of laying tiles for coating surfaces, such as flooring, walls and the like, the use of spacer devices is known which, in addition to spacing the tiles, allow their planar arrangement, that is, they are such as to make the visible surface of the tiles substantially coplanar; these devices are commonly called levelling spacers.

The known levelling spacer devices generally comprise a base, which can be positioned below the laying surface of at least two (three or four) adjacent tiles, from which at least one separator element rises, adapted to slip between the facing sides of the two (three or four) tiles to be placed side by side on the laying surface and protrude beyond the surface in view of the sheet-like products themselves.

The levelling spacer device is also provided with a pusher element cooperating with the portion of the separator element which rises above the plane defined by the surface in view of the tiles. The pusher element is essentially provided with a flat surface facing the base which is adapted to press the surfaces in view of all the products supported by the same base towards the base itself so as to level the surfaces in view.

The known levelling spacer devices include various types, one of which provides that the pusher element is substantially a wedge which slides on the surface in view of the products and enters a window (open or closed) formed in the separator element to push down on the surface in view of the tiles and push them towards the base.

A further type of such levelling spacer devices is that of the so-called screw levelling spacer devices which provide that the pusher element is essentially constituted by a knob equipped with a nut screw which is adapted to be screwed onto a threaded stem (or similar) associated with the raised portion of the separator element.

Other types provide that the pusher means can be of the ring type or cursors that slide vertically.

Once the pusher element has performed its task of levelling the tiles, having waited for the adhesive on which the tile laying surfaces are laid has fully dried, it is sufficient to separate—for example thanks to appropriately predetermined fracture lines formed between the separator element and the base or along the separator element—the separator element from the device side containing the base which will remain immersed in the adhesive below the tile laying surface.

Some sheet-like products, such as glazed or coated tiles that are generally used for covering vertical walls, are particularly delicate, especially at the interface between the glazing and the body of the tile that supports the glaze and, during the use of these levelling spacer devices, the interaction of the pusher element and/or the separator element with the enamel can cause the local breakage or indentation of the latter with consequent aesthetic damage to the tile.

This drawback is noted mainly due to the deformation, during the thrusting action exerted by the pusher element, of the separator element, which when it deforms rubs against one or both facing sides of the sheet-like products (which form the joint between the same) and, in the interface zone between the enamel and the ceramic body that supports the enamel.

This rubbing (which due to the traction exerted by the pusher element on the separator element also has the direct component of moving away from the base) can cause the local detachment of the enamel in the contact zone or the indentation of the latter, with a consequent defect in the tile laid.

An object of the present invention is to overcome the mentioned drawbacks of the prior art, within the context of a simple and rational solution and at a contained cost.

Such purposes are accomplished by the characteristics of the invention given in the independent claim. The dependent claims outline preferred and/or particularly advantageous aspects of the invention.

DISCLOSURE OF THE INVENTION

The invention, in particular, provides a levelling spacer device for the laying of sheet-like products for coating surfaces, comprising:

a base positionable posteriorly to a laying surface of at least two sheet-like products arranged adjacent and side by side relative to a side-by-side direction;

a separator element which rises from said base squareness therewith and adapted to slip between facing lateral sides of said two sheet-like products placed side by side;

a pusher element adapted to cooperate with the separator element; and a plate provided with at least one through opening configured to be inserted onto the separator element, wherein the plate is adapted to be interposed between the pusher element and the base and comprises a first flat surface facing the base wherefrom at least one lamella is projecting which is configured to slip between a lateral side of a sheet-like product and the separator element.

Thanks to this solution, the plate is interposed between the surface in view of the tiles and the pusher element, preventing the latter from rubbing against (or directly contacting) the surface in view itself and, therefore, the plate acts as an anti-scratch element for the surface in view of the tiles; moreover—at the same time—the lamella of the plate is interposed between the separator element and the tile (or the lateral side of the same) and, therefore, it is such as to preserve the enamel or in any case the surface in view of the tiles from any accidental breakage or indentation caused by any rubbing against the separator element.

Preferably, the lamella can comprise a first end constrained to the plate and an opposite second free end (which is inserted between the tile and the separator element).

Advantageously, the first end can be connected to an edge of the through opening, in fact bordering at least one portion.

Thanks to this solution, the insertion of the separator element in the through opening of the plate simultaneously aligns the lamella of the plate with the joint between the tiles into which the lamella itself must be inserted, without requiring particular abilities or additional burdens for the operator responsible for the laying.

According to one aspect of the invention, the lamella can comprise a first flat face which is facing towards the separator element and is intended to come into contact with at least one portion of a sidewall of the separator element, and an opposite second flat face which is intended to face the lateral side of a sheet-like product facing said sidewall of the separator element.

Preferably, but in a non-limiting manner, the separator element can comprise a through window, a shaped (upper) edge of which is intended to be placed at a distance from the base which is greater than a level (or a distance) of a surface in view of the sheet-like products from the base itself.

In this case, the pusher element can comprise a wedge provided with a longitudinal axis and having a tapered end and an opposite enlarged end, wherein the wedge is adapted to be inserted inside the through window on the side of the tapered end and to slide along the side-by-side direction resting on a second surface of the plate opposite the first surface cooperating with said shaped (upper) edge for pushing the sheet-like products towards the base.

Thanks to this solution, the plate is interposed between the wedge and the surface in view of the tiles, allowing their integrity to be further protected.

Advantageously, the lamella can be placed in contact with a sidewall of the separator element which is intended to be turned (posteriorly with respect to a crossing direction of the wedge in the through window, i.e.) towards the enlarged end of the wedge.

Thanks to this solution it is possible to prevent, following a backward flexion of the separator element, for example caused by the insertion of the wedge itself in the through window, the surfaces in view of the posterior tiles from being damaged, broken or indented.

Furthermore, it is possible to provide that the separator element can have a predetermined fracture line or section adapted, in use, to be placed below the level of a surface in view of the sheet-like products resting on the base.

According to a further aspect of the invention, the plate can comprise a plurality of peripheral zones having calibrated thicknesses different from one another.

Thanks to this solution, the plate can be used alone (when not used as a separating element between the tile and the pusher element and/or the separator element) as a simple spacer element (not levelling), simply by using the peripheral zones as removable spacers that can be inserted between lateral facing sides of tiles to define the width of the desired joint.

BRIEF DESCRIPTION OF THE DRAWINGS

Further features and advantages of the invention will be more apparent after reading the following description provided by way of non-limiting example, with the aid of the accompanying drawings.

DETAILED DESCRIPTION

Figure 1:
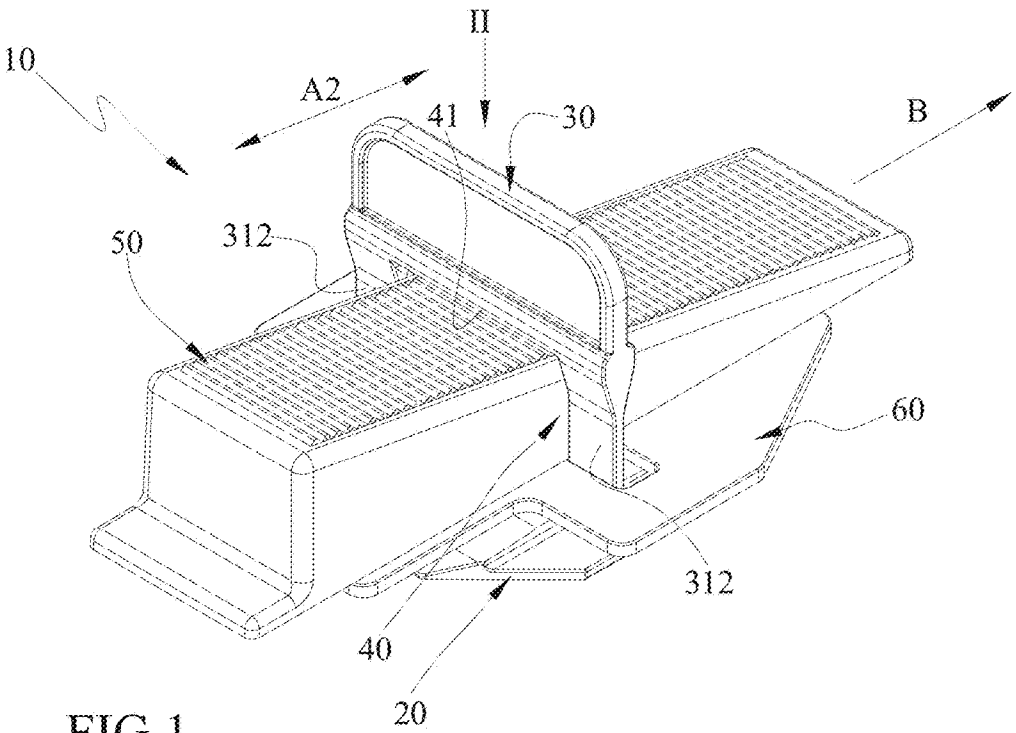
FIG. 1 is an upper axonometric view of a first embodiment of the levelling spacer device according to the invention.
Figure 2:
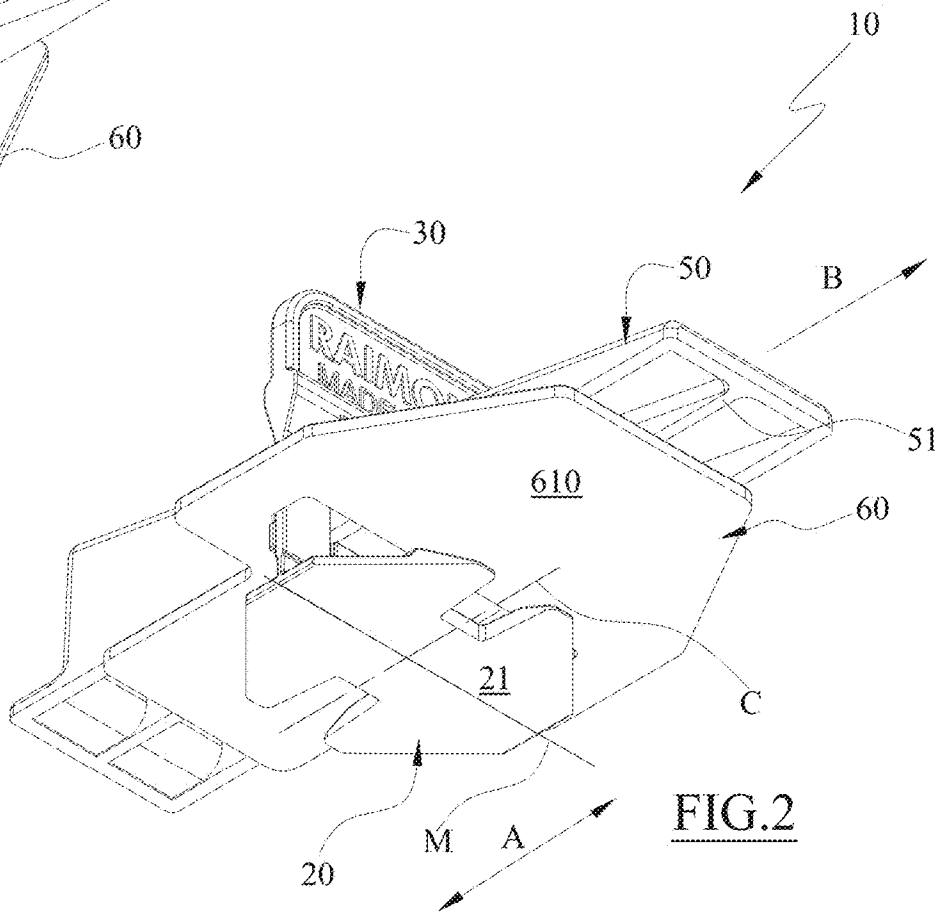
FIG. 2 is a lower axonometric view of FIG. 1.
Figure 4:
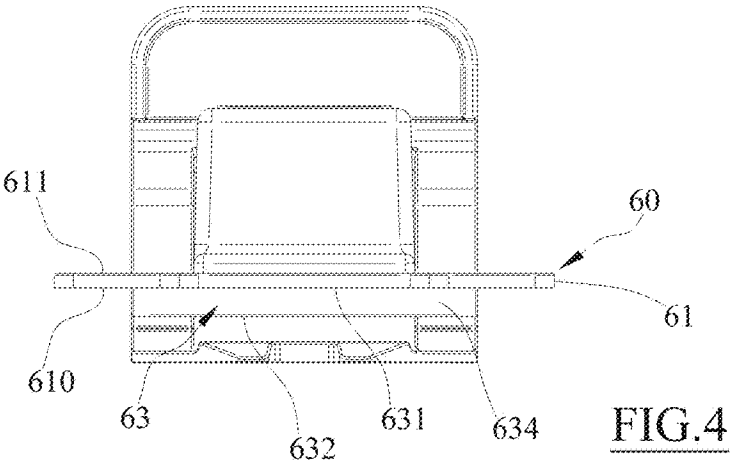
FIG. 4 is a raised front view from IV of FIG. 3.
Figure 3:
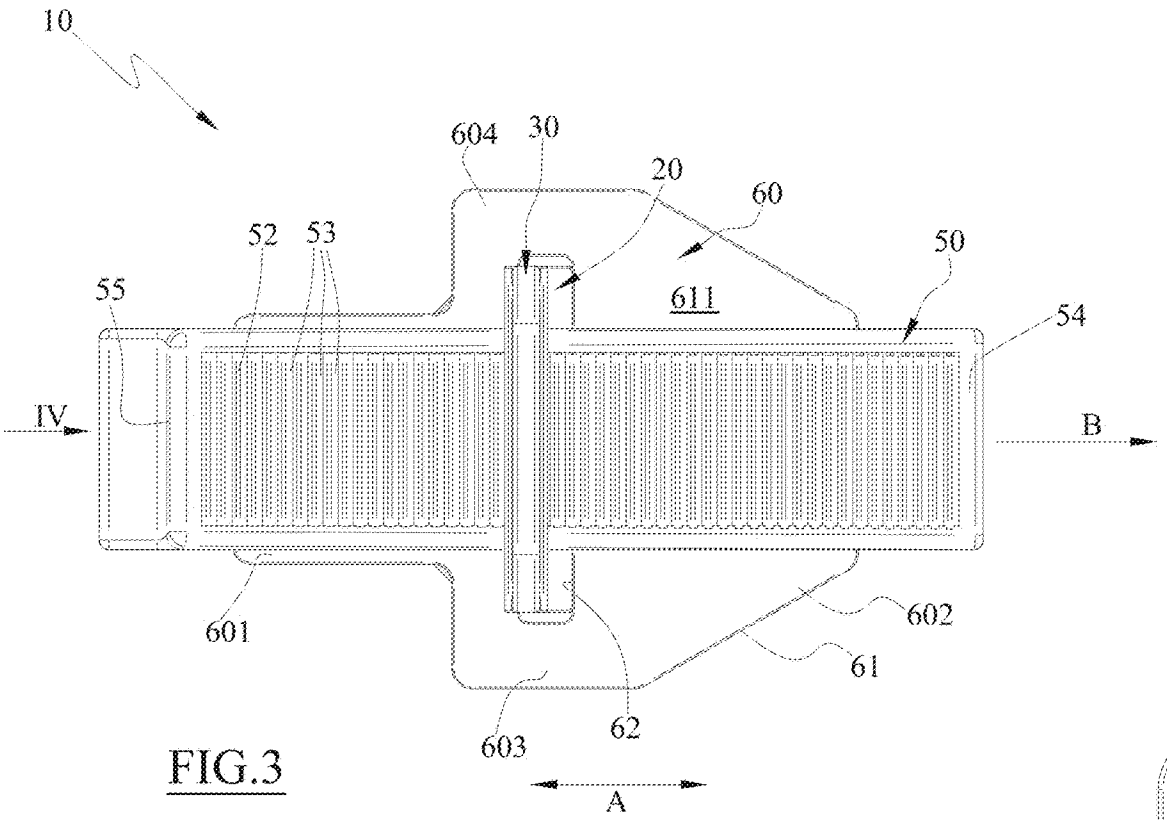
FIG. 3 is a plan view from II of FIG. 1.
Figure 5:
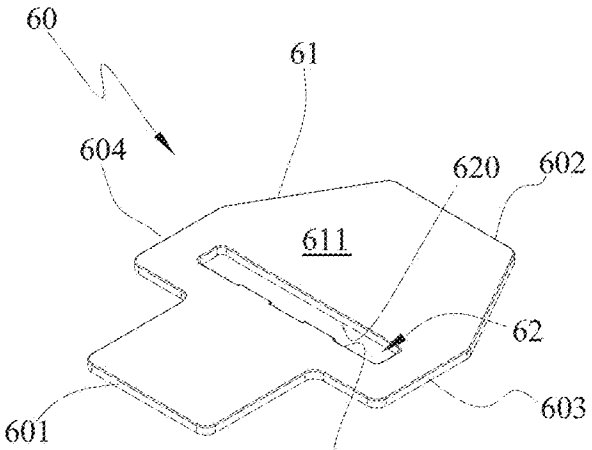
FIG. 5 is an upper axonometric view of a plate of the embodiment of the levelling spacer device according to the invention.
Figure 6:
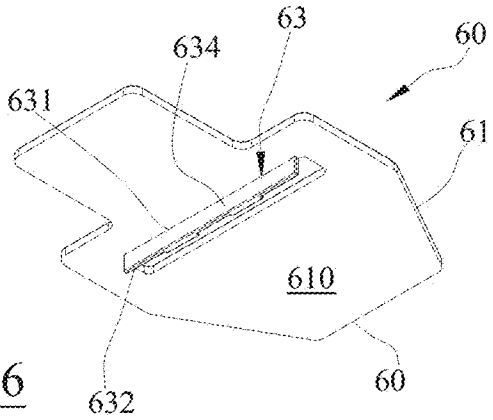
FIG. 6 is a first lower axonometric view of FIG. 5.
Figure 7:
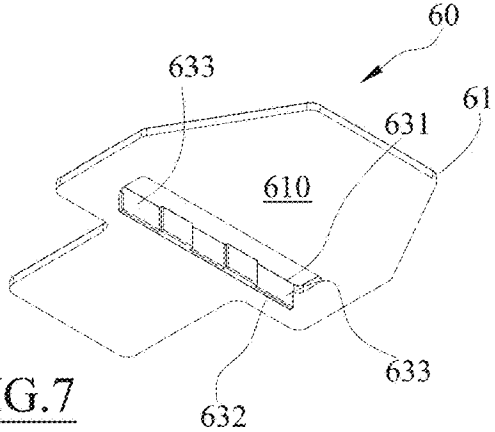
FIG. 7 is a second lower axonometric view of FIG. 5.
Figure 8:
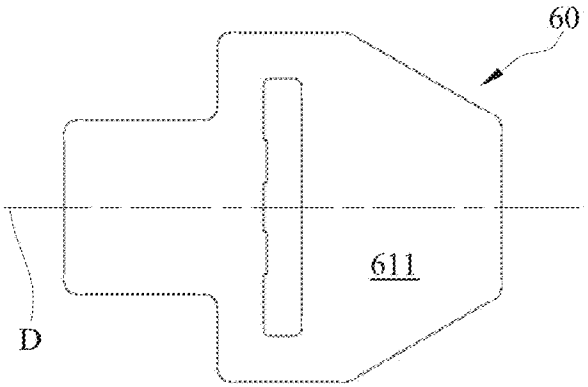
FIG. 8 is a plan view of FIG. 5.
Figure 9:
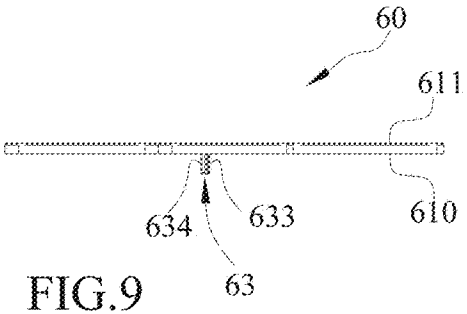
FIG. 9 is a raised side view of FIG. 5.
Figure 10:
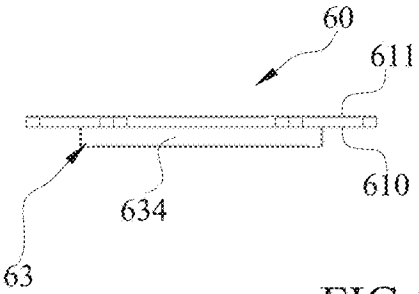
FIG. 10 is a raised front view of FIG. 5.
Figure 15:
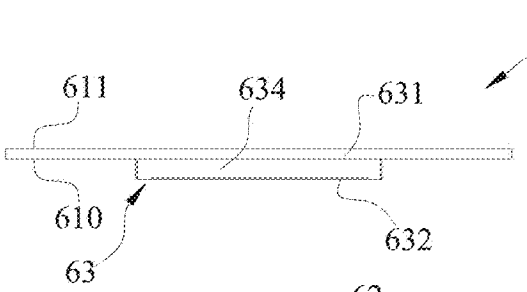
FIG. 15 is a raised front view of FIG. 11.
Figure 11:
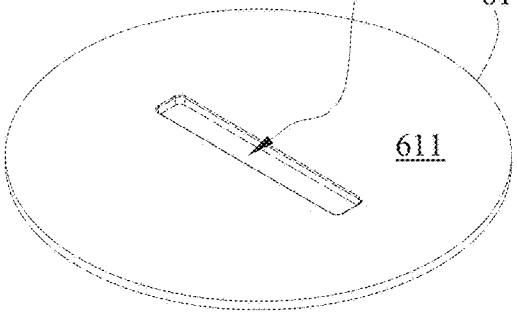
FIG. 11 is an upper axonometric view of a plate of a second embodiment of the levelling spacer device according to the invention.
Figure 12:
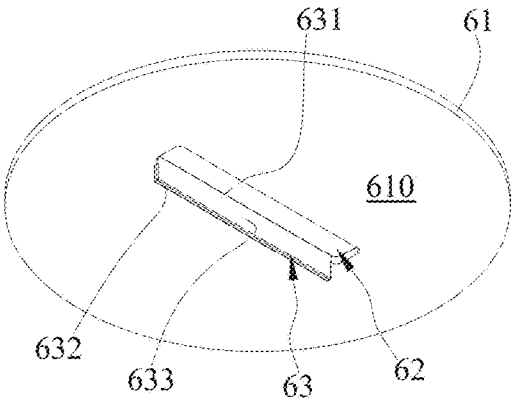
FIG. 12 is a lower axonometric view of FIG. 11.
Figure 14:
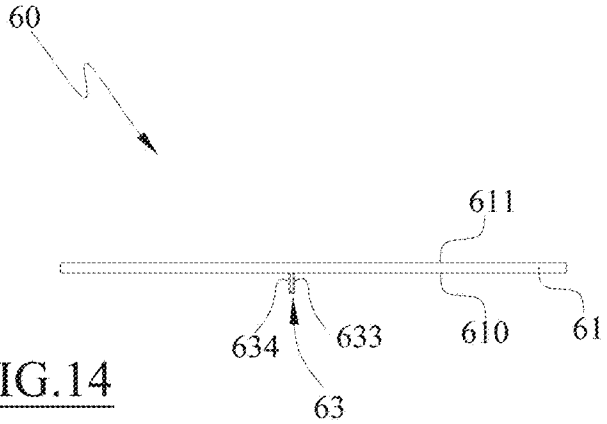
FIG. 14 is a raised side view of FIG. 11.
Figure 13:
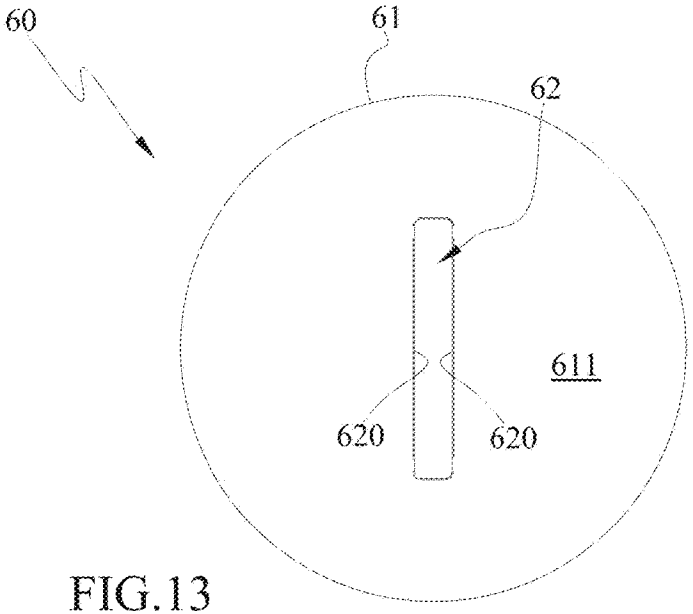
FIG. 13 is a plan view of FIG. 11.
Figure 19:
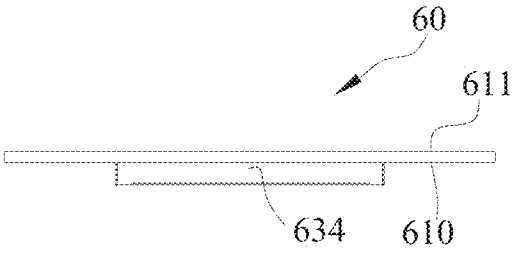
FIG. 19 is a raised front view of FIG. 16.
Figure 16:
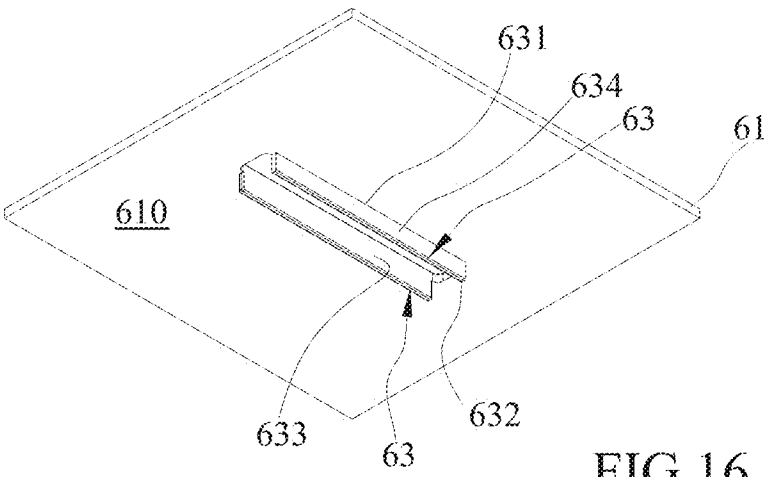
FIG. 16 is a lower axonometric view of a plate of a third embodiment of the levelling spacer device according to the invention.
Figure 18:
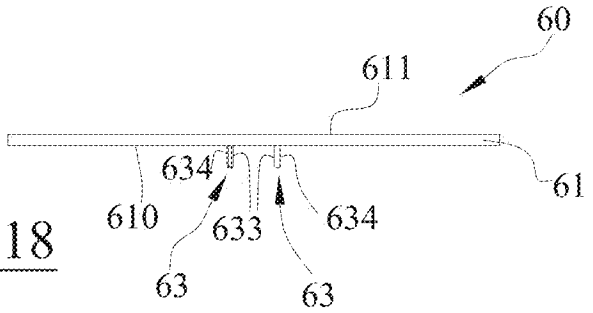
FIG. 18 is a raised side view of FIG. 16.
Figure 17:
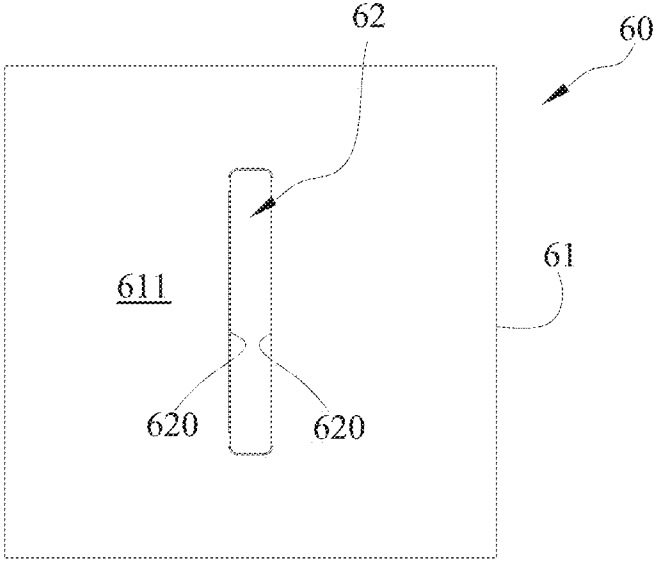
FIG. 17 is a plan view of FIG. 16.

With particular reference to these figures, the reference number 10 generally designates a levelling spacer device adapted to facilitate the laying of sheet-like products, such as tiles and the like, generally indicated with the letter P, and adapted for coating surfaces, i.e. walls (vertical), flooring (horizontal), ceilings and the like. In the following, a wedge-type device 10 will be described in detail, for which the advantages connected to the solution which is the object of the present invention are certainly more evident and relevant with respect to other types of levelling spacer devices, however the solution of the present invention can be used in an equivalent manner in different types of levelling spacer devices, such as those with a nut screw, slider or ring.

Each tile P, adapted for being laid to coat a surface (masonry), has a wide laying surface P1, for example lower, and an opposite wide surface in view P2, for example upper, preferably of homologous shape (for example polygonal, preferably quadrangular) with respect to the laying surface P1.

Each tile P then comprises a plurality of lateral sides P3, generally squareness with the laying surface P1 and the surface in view P2, which laterally delimit the tile itself.

The device 10 comprises a base 20 which is adapted to be placed posteriorly to the laying surface P1 of the tiles P (shown only schematically in FIGS. 20*a*-20*f* and 25).

In the examples shown, the base 20 is defined by a monolithic body, for example made of a plastic material (obtained by injection moulding), which has a substantially polygonal shape (in plan).

In the example shown, the base 20 has an irregular shape (in plan), for example substantially octagonal, elongated along a main axis C.

The base 20 has a symmetrical shape with respect to a median plane M orthogonal to the base itself, for example with respect to a plane orthogonal to the main axis C of the same.

The base 20 comprises a lower surface 21, for example flat or V-shaped.

The lower surface 21 is adapted to be rested on a layer of adhesive arranged on the screed which is intended to be coated by the tiles P; in practice, the lower surface 21 is adapted to be arranged distal to the laying surface P1 of the tiles P in use.

The base 20 also comprises an upper surface 22 opposite the lower surface 21, for example flat or suitably shaped, adapted to be arranged near the laying surface P1 of the tiles P and, for example, in contact therewith.

The upper surface 22 of the base 20 is, in practice, intended to receive in support a portion of the laying surface P1 of one or more tiles P (side by side).

In the example shown and only by way of example, the upper surface 22 comprises a central portion defining a resting surface for two side-by-side tiles P.

The resting surface, i.e. the highest flat surface of the upper surface 22 which defines for example the central portion, is placed at a first distance from the lower surface 21.

The resting surface is the surface of the base 20 which is farthest from the lower surface 21.

In practice, the maximum thickness of the base 20 is defined by the first distance.

The resting surface is substantially parallel to the lower surface 21 (planar).

The upper surface 22 of the base 20 also comprises two lateral portions facing each other with respect to the central portion, for example symmetrical (and equal) with respect to the median plane M of the base 20 orthogonal to the resting surface and intersects the central portion and the lateral portions.

Each lateral portion defines a planar surface placed at a second distance from the lower surface 21, wherein the second distance d2 is less than the first distance.

In practice, the thickness of each lateral portion of the base 20 is defined by the second distance and is less than the thickness of the central portion of the base itself.

Each lateral surface is a plane substantially parallel to the lower surface 21 (planar) and to the resting surface (the two being distinct).

The upper surface 22 comprises a connecting surface interposed between each planar surface and the resting surface.

The connecting surface is substantially orthogonal to the planar surface and to the resting surface, defining the elevation of a step between them.

Each lateral portion of the upper surface 22, i.e. each planar surface, has a longitudinal extension, i.e. has a prevalent extension direction, along the main axis C, which is orthogonal to the median plane M of the base 20 which intersects the central portion and the lateral portions.

In practice, each planar surface defines an elongated strip (having a length greater than the width) with the main axis C orthogonal to the aforesaid median plane M of the base 20 and placed at a lower level than the level defined by the resting surface defined by the central portion of the base 20.

The planar surface has a substantially trapezoidal plan shape, for example of an isosceles trapezoid, wherein the larger base is near the resting surface, or is joined thereto by means of the connecting surface, and the smaller base, opposite it, defines the lateral (free) end distal from the central portion of the base 20.

The upper surface 22 of the base 20 comprises a pair of opposed inclined surfaces 225 with respect to the median plane M of the base 20 which intersects the central portion and the lateral portions.

Each inclined surface 225 defines a ramp rising from the end of the base 20 (distal from the median plane M) towards the aforementioned median plane M in a direction orthogonal to the median plane M and which connects the lower surface 21 of the base 20 to the upper surface 22, i.e. to the resting surface of the central portion of the base 20.

Each inclined surface has a maximum distance from the lower surface 21 equal to the first distance and a minimum distance from the lower surface 21 comprised between zero and the second distance, preferably equal to the second distance.

Each inclined surface 225 lies on a plane inclined at an acute (internal) angle with respect to the lower surface 21. In practice, each inclined surface 225 defines a thickness gradient of the base 20 which facilitates the operator responsible for laying the tiles P to insert the base 20 below the laying surface P1 of the tiles P when these are already resting on the adhesive layer.

The base 20 comprises a pair of opposed slots 23 passing from the lower surface 21 to the upper surface 22, which are located at the central portion of the upper surface 22.

Each slot 23 has an elongated shape, i.e. it has a prevalent extension direction, along a longitudinal axis orthogonal to the median plane M of the base 20 which intersects the central portion and the lateral portions.

In practice, each slot 23 has a longitudinal axis parallel to the longitudinal axis A of the lateral portions of the upper surface 22 of the base 20.

Each slot 23 is open laterally at a respective end of the base 20 distal from the median plane M and defines a longitudinal split through the base 20 from the distal end of the median plane M towards the same and with a prevailing direction orthogonal to it. For example, each slot 23 is adapted to intersect a respective inclined surface 225 dividing this into two separate portions along a direction parallel to the median plane M and to the lower surface 21.

The device 10 further comprises a separator element 30 which rises in squareness from the base 20, for example at the median plane M of the same, which is, in use, adapted to slip between facing lateral sides P3 of at least two (or more) tiles P to be placed side by side along a side-by-side direction indicated in the figures with the letter A (parallel to the central axis C and orthogonal to the median plane M of the base 20) and to contact the same, substantially defining the width of the interspace (or joint) between the side-by-side tiles P.

In practice, the separator element 30 rises (vertically) from the upper surface 22 of the base, squareness therewith.

The separator element 30 is a sheet-like parallelepiped body, for example with a rectangular base that defines a thin separation wall.

In particular, the separator element 30 comprises two legs 31 parallel to each other and each rising from (a respective lateral portion of) the upper surface 22 of the base 20, for example in a direction orthogonal to the resting surface of the upper surface 22 of the base itself.

The separator element 30 then comprises a crosspiece 32 which joins the top of the two legs 31 and is arranged with a longitudinal axis parallel and at a distance from the upper surface 22 of the base 20.

In fact, the legs 31 and the crosspiece 32 define a substantially bridge-like or portal-like shape of the separator element 30.

Preferably, the separator element 30 is made in a single body (monolithic) with the base 20, i.e. for example it is obtained by moulding plastic material together with the base itself (and using the same plastic material).

The separator element 30 is globally defined by a sheet-like body arranged parallel to the median plane M of the base 20, so that the median plane M of the base 20 is also a median plane of the separator element 30 itself.

Each leg 31 of the separator element 30 has, in the example, a lower end fixed to the planar surface of the respective lateral portion.

Each leg 31 of the separator element 30 is connected to the planar surface of the respective lateral portion of the base 20 in a frangible way by means of a predetermined fracture line 310.

The fracture line 310 is parallel to the planar surface (and to the median plane M) and is placed at a third distance from the lower intermediate surface with respect to (comprised between) the first distance and the second distance.

For example, the third distance is closer to the second distance than to the first distance.

It is not excluded that the third distance coincides with the first distance or with the second distance or is greater than the first distance according to need.

Each leg 31 of the separator element 30 is substantially sheet-like and has a longitudinal axis (prevalent direction) orthogonal to the planar surface of the lateral portion from which it is derived.

Each leg 31 has a height (in a direction parallel to its longitudinal axis) greater than the thickness (height) of the tiles P to be placed side by side, so that the crosspiece 32 of the separator element 30 is always at one level (distance from the resting surface defined by the upper surface 22) higher than the level of the surface in view P2 of the tiles P to be placed side by side.

Each leg 31 has a width, with width intended as the dimension parallel to the median plane M (which intersects both the legs 31 and the crosspiece 32 of the separator element 30), which is smaller than the width of the planar surface of the respective lateral portion.

In practice, each leg 31 (or its edge facing the other leg 31) has a distance (not zero) from the connecting surface of the upper surface 22 of the base 20, i.e. a cavity is defined between each leg 31 and the connecting surface.

Each leg 31 has a variable thickness (for example in sections) along its longitudinal axis.

Leg thickness 31 is intended as the size of the leg 31 in the direction orthogonal to the median plane M of the separator element 30 which intersects both the legs 31 and the crosspiece 32 of the separator element 30 itself.

Each leg 31 comprises a central sector axially interposed between the crosspiece 32 and the lower end of the leg 31, wherein the central sector is provided with two opposite sidewalls 312 with respect to the median plane M and parallel to each other.

The sidewalls 312 of the central sector are the zone of the leg 31 which substantially comes into contact with the side-by-side tiles P resting on the central portion of the upper surface 22 of the base 20 substantially defining the mutual distance in a direction orthogonal to the median plane M.

The distance between the sidewalls 312, i.e. the calibrated thickness of the separator element 30, substantially defines the width of the joint (interspace) between the tiles P.

Each leg 31 then comprises a block adapted to interconnect the central sector with the planar surface of the respective lateral portion of the base 20.

The block has a thickness, i.e. a cross-section made with respect to a plane orthogonal to the median plane M, which is smaller than the mutual distance between the two sidewalls 312 of the central sector.

The block has an upper end connected to the central sector and a lower end, which coincides with the lower end of the leg 31 as a whole, connected directly to the planar surface of the respective lateral portion of the base 20.

The fracture line 310 is defined at the block, in a zone near the lower end thereof.

The fracture line 310 is defined by a longitudinal notch defining the zone having the smallest cross-section (in any direction and in particular in the direction orthogonal to the median plane M) of the entire leg 31.

The longitudinal notch defining the fracture line 310 defines the triggering zone of the fracture of the separator element 30 with respect to the base 20.

The longitudinal notch has a longitudinal axis parallel to the planar surface of the respective lateral portion and to the median plane M and is fully extended, i.e. it occupies the entire width of the leg 31 (i.e. of the block).

The longitudinal notch has a cross-section (i.e. with respect to a plane orthogonal to the median plane M) which is constant along the entire length of the same and has a rounded concave shape according to a first radius of curvature.

In practice, the shape of the longitudinal notch is substantially semi-cylindrical.

Each leg 31, i.e. each block, comprises a pair of identical fracture lines 310, i.e. longitudinal notches, symmetrically arranged with respect to the median plane M of the separator element 30 (and of the base 20). In practice, the minimum section of the leg 31, which triggers the fracture of the separator element 30, is defined at the connecting plane of the minimum of the concave rounded shape according to a first radius of curvature defining the two longitudinal notches.

The upper end of the block extends above the level defined by the resting surface of the central portion of the upper surface 22 of the base 20.

The upper end of the block is connected to the central sector of the leg 31 by means of a rounded connecting surface and/or walls inclined in a V shape.

The crosspiece 32 comprises a cross-section (with respect to a plane orthogonal to the median plane M) defining a zone with increased thickness in a zone near the upper end of the legs 31 and extending entirely in a longitudinal direction.

This thicker zone defines a reinforcing beam for the separator element 30.

This thicker zone is overhanging at the top with a thinner gripping portion and is connected to the legs 31 by means of inclined connecting surfaces.

The reinforcing beam, in the zone interposed between the legs 31, i.e. superimposed on the central portion of the upper surface 22 of the base 20, ends below with a shaped edge 41, for example a V shape with a free vertex facing the base 20.

The distance of the shaped edge 41 from the central portion of the upper surface 22 of the base 20 is (abundantly) greater than the thickness of the tiles P to be laid. With its above-described portal shape, the separator element 30 and the base 20 attached thereto delimit a through window 40 which crosses the separator element 30 and the base 20 in a direction orthogonal to the median plane M of the same.

The through window 40 is delimited around the perimeter by the crosspiece 32, the legs 31 of the separator element 30 and by the upper surface 22 of the base 20.

More in detail, the through window 40 is delimited at the top by a V-shaped edge 41 of the reinforcement beam of the crosspiece 32, below (almost entirely) the resting surface of the central portion of the upper surface 22 of the base (i.e. the zone of the same subtended to the crosspiece 32) and laterally from the facing sides of the legs 31.

The through window 40 has a substantially rectangular shape.

The device 10 also comprises a pusher element 50, for example of the wedge type, which is separated from the base 20 and from the separator element 30 (or made in a separate body with respect thereto).

The pusher element 50 is a rectangular wedge, for example it is provided with a flat lower surface 51 and adapted to be arranged, in use, parallel to the resting surface of the central portion of the upper surface 22 of the base 20 and an inclined upper surface 52 (of an acute angle, for example less than 45°) with respect to the lower surface 51 and provided with abutment elements, such as teeth 53 or knurls.

The pusher element 50 then comprises two parallel sidewalls.

The pusher element 50 has a variable thickness (and constantly increasing) along its longitudinal axis from a tapered end 54 towards an opposite enlarged end 55.

The pusher element 50 is configured to be axially inserted, through its tapered end 54, with clearance through the through window 40 (defined between the base 20 and the separator element 30) of the device 10 along a direction (unidirectional) of crossing B (see FIG. 20*d*) which is orthogonal to the aforementioned median plane M of the separator element 30 and of the base 20.

For example, the maximum height of the pusher element 50 (maximum distance between its lower surface 51 and its upper surface 52, at its enlarged end 55) is less than the height of the through window 40 defined by the distance between the crosspiece 32 (i.e. its shaped edge) and the upper surface 22 of the base 20 (i.e. its resting surface).

The shaped edge 41 of the crosspiece 32 is able to engage the teeth 53 substantially like a pop-up during the translation inside the through window 40 along the direction of crossing B.

The width of the pusher element 50 is substantially equal (slightly less) than the distance between the two legs 31 (or between the two facing edges thereof).

The pusher element 50 is adapted to be inserted inside the through window 40 through its tapered end 55 and slide in the direction of crossing B, with the lower surface 51 facing the surfaces in view P2 of the tiles P resting on the resting surface defined by the upper surface 22 of the base 20, so that the upper surface 52 of the pusher element 50 comes into forced contact with the shaped edge 41 of the crosspiece 32 and the same pusher element 50 generates a pressure in a direction orthogonal to the resting surface of the base 20 on both the tiles P, placed on opposite sides with respect to the separator element 30, for pushing them towards the base 20 and, therefore, levelling them.

It is not excluded that the wedge-shaped pusher element 50 may have a tapered end 54 which is bifurcated i.e. is provided with a central slot, in which case the separator element 30 may be of the central lamella type which slips into the central slot during the levelling sliding of the pusher element 50.

The device 10 comprises, in particular, a plate 60 which is adapted to be interposed—in operation—between the base 20 and the pusher element 50, or between the pusher element 50 (or its lower surface 51) and the surface in view P2 of the tiles P resting on the base 20.

In detail, in use the pusher element 50 is movable, for example sliding (with respect to the base 20 and with respect to the surface in view P2 of the tiles P inside the through window 40), with respect to the plate 60, which is kept stationary (as will be clearer below) with respect to the surface in view P2 of the tiles P.

In this case, the plate 60 comprises a sheet-like body 61, for example of thin thickness, preferably defined by a monolithic body, advantageously made of a plastic material (obtained by injection moulding).

In a first and a fourth embodiment shown in FIGS. 1-10 and 21-25, the plate 60 has a substantially polygonal plan shape, in the example elongated along a longitudinal axis D and, preferably, asymmetric with respect to a median plane orthogonal to this longitudinal axis D.

In the example, the plate 60 has an overall plan shape of an arrow (unidirectional), so as to identify a rear longitudinal end 601 (or tail) and an opposite front longitudinal end 602 (head).

Thanks to this arrow shape of the plate 60 it is possible to visually identify a preferential sliding direction (which goes from the rear longitudinal end 601 to the front longitudinal end 602) which guides the sliding of the pusher element 50 in this direction in the insertion thereof inside the through window 40, as will better described.

Furthermore, the tip of the arrow of the plate 60 has two opposite side ends, for example a right side end 603 and a left side end 604, which project laterally with respect to the lateral encumbrance of the rear longitudinal end 601 and the front longitudinal end 602 (these last two having a width or lateral encumbrance, i.e. orthogonal to the longitudinal axis D, substantially equal to the width of the lower surface 51 of the pusher element 50).

It is not excluded, however, that the plate 60 may have a substantially circular plan shape, as shown in a second embodiment illustrated in FIGS. 11-15, or a substantially polygonal plan shape of any shape according to need, quadrangular for example (rectangular or square), as shown in a third embodiment illustrated in FIGS. 16-19.

In any case, the plate 60 has a lower greater face (facing the base 20 or the surface in view P2 of the tiles P, when in use) and an opposite lower greater face (facing the pusher element 50, when in use).

The plate 60, i.e. the plate-like body 61 thereof, comprises—at its lower greater face—a first surface 610 (lower), which is intended to face the base 20 (i.e. facing the upper surface 22 of the base itself), when in use (i.e. when the plate 60 is axially interposed between the base 20 and the pusher element 50 themselves).

Moreover, the plate 60 comprises—at its upper greater face—an opposite second surface 611 (upper) intended to face the pusher element 50, when in use.

More particularly, the first surface 610 of the plate 60 is intended to be facing the surface in view P2 of the tiles P placed side by side and resting on the upper surface 22 of the base 20 and is configured to come into contact with the surface in view P2 of the tiles P themselves.

The first surface 610 and the second surface 611 are, for example, individually planar and substantially parallel to each other; preferably the first surface 610 and the second surface 611, in use, are substantially orthogonal to the sidewalls 312 of the separator element 30.

The second surface 611 is adapted to come into contact (sliding, for example along a rectilinear sliding trajectory) with the lower surface 51 of the pusher element 50, during the translation of the pusher element 50 inside the through window 40 in the direction of crossing B.

The second surface 611 (planar) could concern (occupy) the entire area of the upper greater face of the plate 60 or only a portion thereof (i.e. an elongated full-extension strip).

In the first and fourth embodiments shown, respectively in FIGS. 1-10 and 21-25, the second surface 611 extends longitudinally from the rear longitudinal end 601 to the front longitudinal end 602.

As illustrated for example in the fourth embodiment shown in FIGS. 21-25 (however, it cannot be excluded that it may relate to all the embodiments of the plate 60), the plate 60 could provide one or more centring reliefs 612 placed at the upper face and surrounding, for example laterally, the second surface 611, so as to define a longitudinal track engageable by the pusher element 50 to guide its translation on the second surface 611 itself.

The first surface 610 is adapted to come into contact with the surface in view P2 of the (two or more) tiles P which are resting on the (upper surface 22 of) the base 20 (and remain substantially stationary, resting during the translation with which the pusher element 50 engages the through window 40).

The first surface 610, in use, is adapted to come into contact with the surface in view P2 of the tiles P remaining substantially integral thereto (stationary, without sliding) during the translation with which the pusher element 50 engages the through window 40.

The first surface 610 (planar) could concern (occupy) the entire area of the lower greater face of the plate 60 or only a portion thereof.

In practice, the first surface 610 of the plate 60 is defined by the portion of the lower greater face of the plate 60 which is more distal from the upper greater face of the plate itself, on which the plate 60 rests when it is resting on the lower greater face itself (on the tiles P).

The plate 60 then comprises a through opening 62, for example substantially central (i.e. central with respect to the first surface 610 and the second surface 611), which crosses from side to side (from the first surface 610 to the second surface 611) of the sheet-like body 61 of the plate 60 and is open at the upper greater face and the opposite lower greater face of the plate 60 itself.

The through opening 62 could be closed around the perimeter, as shown, or alternatively it could be open around the perimeter, for example on one side.

In a preferred embodiment shown in FIGS. 1-12, the through opening 62 has an elongated shape like a slit with a longitudinal axis transverse (orthogonal) to the longitudinal axis D of the plate 60, or in any case perpendicular to the side-by-side direction A (and to the direction of crossing B), in operation, and preferably, it crosses the centre line (or the median plane) of the second surface 611.

In practice, this through opening 62 shaped like a slit is centred on the median plane of the plate 60 orthogonal to its longitudinal axis.

In the example, this through opening 62 shaped like a slit is narrow and long, with a length (greater dimension) slightly greater than the width (i.e. the maximum dimension parallel to the median plane M) of the separator element 30 and with a width (smaller dimension) slightly larger (for example less than 2 times) than the maximum thickness of the separator element 30 (i.e. the thickness in a direction orthogonal to the median plane M of the zone with increased thickness of the separator element itself).

This through opening 62 shaped like a slit is therefore configured to slip (with clearance) onto the separator element 30 (so that through the through opening 62 the plate 60 can connect to the separator element 30 with a substantially prismatic connection which allows the sliding in a direction orthogonal to the base 20 of the plate 60, but prevents a mutual rotation or translation of the plate 60 in a direction parallel to the base 20).

In practice, the separator element 30 can be inserted axially inside the through opening 62 shaped like a slit by means of its free end distal from the base 20 and, once the separator element 30 is engaged inside the through opening 62, the mutual rotation and translation in a direction parallel to the base 20 is prevented (except for small oscillations or deviations due to the tolerances in clearance and to the necessary clearance which allows the comfortable insertion of the separator element 30 in the through opening 62) between the plate 60 and the separator element itself.

In this case, the through opening 62 shaped like a slit, for example, has substantially straight and parallel longitudinal edges 620 between which the separator element 30 is substantially received at its size (with reduced lateral clearance).

It is not excluded that the through opening 62 can be shaped differently from the one illustrated and described according to the needs and the shape of the separator element 30.

Particularly, the plate 60 comprises a lamella 63 which protrudes and extends from the lower greater face of the plate itself beyond the first surface 610 and substantially in squareness therewith.

In practice, the lamella 63 has a first end 631 constrained to the plate 60, i.e. derived from and connected to the lower greater face and/or to the first surface 610, and an opposite free second end 632, which is placed on the opposite side of the second surface 611 with respect to the first surface 610.

The first end 631 of the lamella 63 is directly connected to a longitudinal edge 620 of the through opening 620, for example for the entire length for a limited portion thereof.

It is possible to provide that for a longitudinal edge 620 of the through opening 62 there is only one lamella 63 or multiple lamellae spaced apart or, as shown in FIGS. 16-19 (but not limited only to the third embodiment), both longitudinal edges 620 of the through opening 62 are provided (and extended) by a respective lamella 63 (or by multiple lamellae spaced apart).

Each lamella 63 comprises a first flat face 633 and an opposite second flat face 634 parallel and orthogonal between them, singularly, to the first surface 610 of the sheet-like body 61 of the plate 60.

The mutual distance between the first flat face 633 and the second flat face 634 defines the thickness of the lamella 63, which is preferably smaller than (or equal to) the thickness of the separator element 30, i.e. the distance between the sidewalls 312 (of each leg 31) thereof.

The first flat face 633 is closer (proximal) to the longitudinal edge 620 of the through opening 62 opposite the edge from which the lamella 60 is derived (for example substantially coplanar therewith), the second flat face 634, instead, is farther away (distal) from the longitudinal edge 620 of the through opening 62 opposite the edge from which the lamella 60 is derived.

The first flat face 633 could concern (occupy) the entire longitudinal development and/or width of the side of the lamella 63 on which it is formed or only one or more portions thereof, in the example the first flat face 633 concerns two lateral end portions of the lamella 63 joined by a central zone of the lamella 63 having a greater reinforcement thickness.

Also the second flat face 634 could concern (occupy) the entire longitudinal development and/or width of the side of the lamella 63 on which it is formed or only one or more portions thereof, in the example the second flat face 633 concerns the entire side of the lamella 63 on which it is formed.

The lamella 63 is configured so that it can be inserted, by means of its second free end 632, into a (narrow) interspace provided between a sidewall 312 (or the two sidewalls 312 facing the enlarged end 52 of the pusher element 50) and a lateral side P3 of one or more tiles P near (or in any case facing) this sidewall 312 (when the first surface 610 of the plate 60 rests on the surface in view P2 of one or more tiles P which rest on the upper surface 22 of the base 20).

In practice, the lamella 63—protruding (cantilevered) from the first surface 610 of the plate 60 in a zone thereof which is necessarily placed side by side with the separator element 30, when the latter is inserted inside the through opening 62 of the plate 60 (inserts in the joint defined between the side-by-side tiles P along the side-by-side direction A) and wedges between the coplanar sidewalls 312 (located on the same side) of the separator element 30 and the lateral side P3 of the tile(s) P facing them, in fact covering an apical (edge) portion of the lateral side P3 itself which is connected with the surface in view P2 of the tile(s) P itself.

The first flat face 633 of the lamella 63 is facing the separator element 30 and is intended, in use (i.e. when it is inserted into the joint between the tiles P), to come into contact with at least one axial portion of (both) sidewalls 312 of the separator element 30 itself.

The central zone of the lamella 63 has a greater reinforcement thickness and is configured to be actually inserted into the through window 40 without therefore further enlarging the joint between the tiles P.

The second flat face 634 of the lamella 63 is instead intended, in use (i.e. when it is inserted into the joint between the tiles P), to come into contact with at least one apical portion (i.e. near the surface in view P2) of the lateral side P3 of the tile(s) P arranged on the same side as the sidewalls 312 in contact with the first flat face 633.

In practice, when the lamella 63 is inserted into the joint between the tiles P, it is intended to be interposed and clamped (directly) between the separator element 30, i.e. a pair of coplanar sidewalls 312 thereof, and one or more tiles P, i.e. the lateral side P3 thereof.

The second flat face 634 of the lamella 63 is in fact turned towards the enlarged end 55 of the pusher element 50 when this is inserted (in the direction of crossing B) in the through window 40 (defined between the separator element 30 and the base 20), the first flat face 633 of the lamella 63, on the other hand, faces the tapered end 54 of the pusher element 50 when this is inserted (in the direction of crossing B) in the through window 40 (defined between the separator element 30 and the base 20).

The lamella 63 has a height, with height intended as the distance between the first end 631 and the second end 632, which is (much) less than the thickness of the tiles P (which can be laid with the device 10), i.e. the distance between the surface in view P2 and the laying surface P1 of the same.

For example, the height of the lamella 63 is substantially equal (or in any case comparable) to the width of the through opening 62 (i.e. the distance between the two longitudinal edges 620 of the same).

Furthermore, the plate 60 can have peripheral zones, such as for example opposite or adjacent sides, or opposite or adjacent ends, which have different calibrated thicknesses between them.

For example, as shown in the fourth embodiment in FIGS. 21-25 (but not limited to this embodiment), the front longitudinal end 602 has a first thickness (equal to the rear longitudinal end 601 and) different at a second thickness of the left side end 604 (and for example different at a third thickness of the right side end 603).

Thickness in particular is intended as the distance between the upper greater face and the lower greater face at this peripheral zone of the plate 60 (wherein—preferably—the upper greater face and the lower greater face are locally parallel to each other).

For example, the first thickness corresponds to the minimum thickness of the plate 60, the second thickness is greater than the first thickness (for example equal to ⅔ of the first thickness) and the possible third thickness is greater than the first thickness and the second thickness (for example double the first thickness s1).

Preferably, the first thickness (and/or the second thickness and/or the third thickness) is substantially equal to the thickness of the central sector (i.e. the distance between the parallel and pair of sidewalls 312) of the separator element 30 to be used for the laying of the tiles P.

In practice, each peripheral zone of the plate 60, i.e. the front longitudinal end 602 (and/or the rear longitudinal end 601), the right side end 603 and the left side end 604 can be selectively used as spacer elements (not levelling) between the side-by-side tiles P defining the width of the joint between the same, if individually inserted (cutting, i.e. the first surface 610 of the plate 60 substantially perpendicular to the surface in view P2 of the tiles P) in the interspace between two side-by-side tiles P.

In light of the above, the operation of the device 10 is as follows.

To coat a surface with a plurality of tiles P it is sufficient to apply a layer of adhesive on it and, subsequently, it is possible to lay the tiles P with the laying surface P2 facing towards and in contact with the layer of adhesive.

Figures 20A, 20B, 20C, 20D:
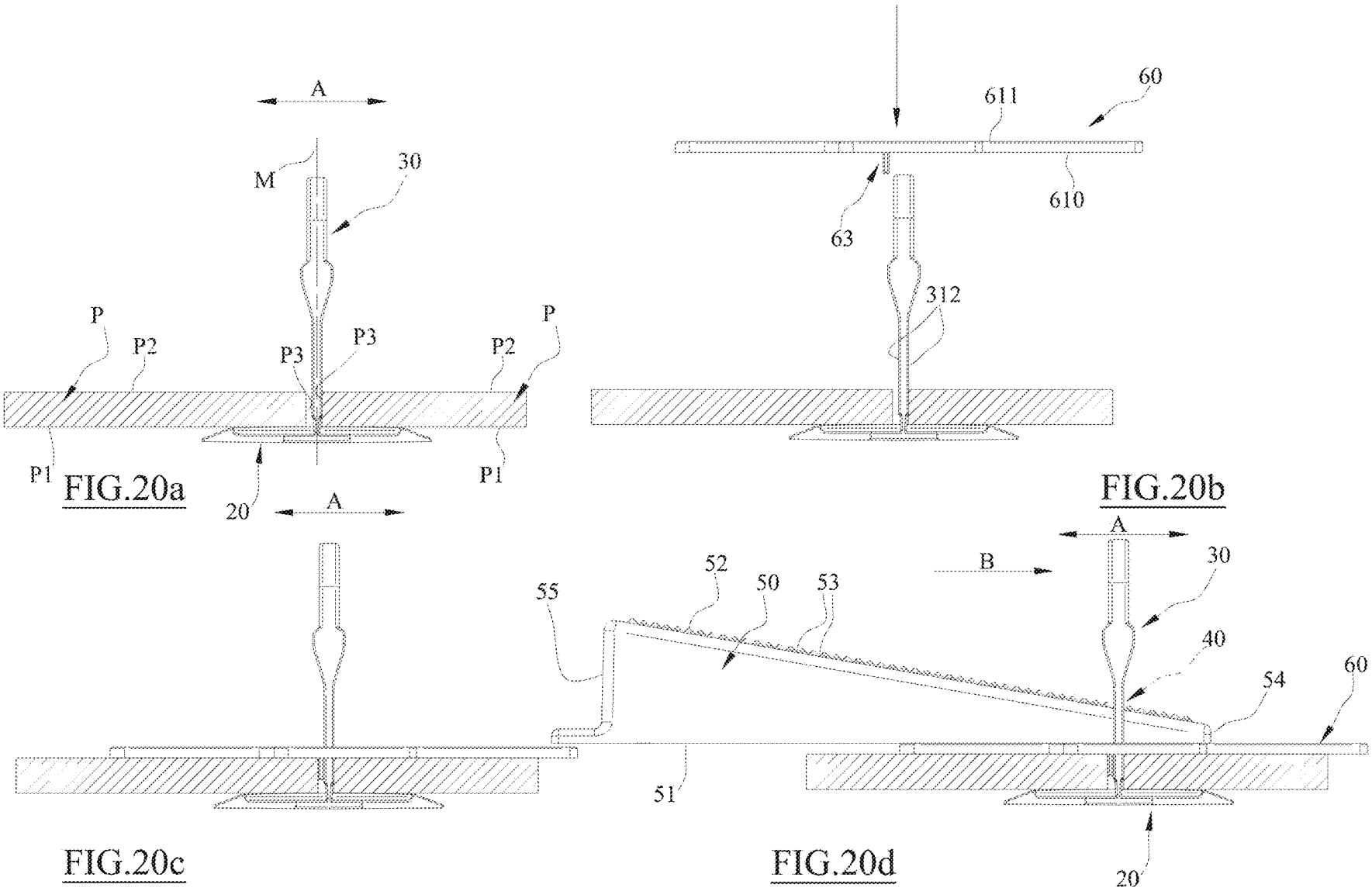
FIGS. 20*a*-20*f* are an operating sequence of the levelling spacer device according to the invention.
Figure 20E:
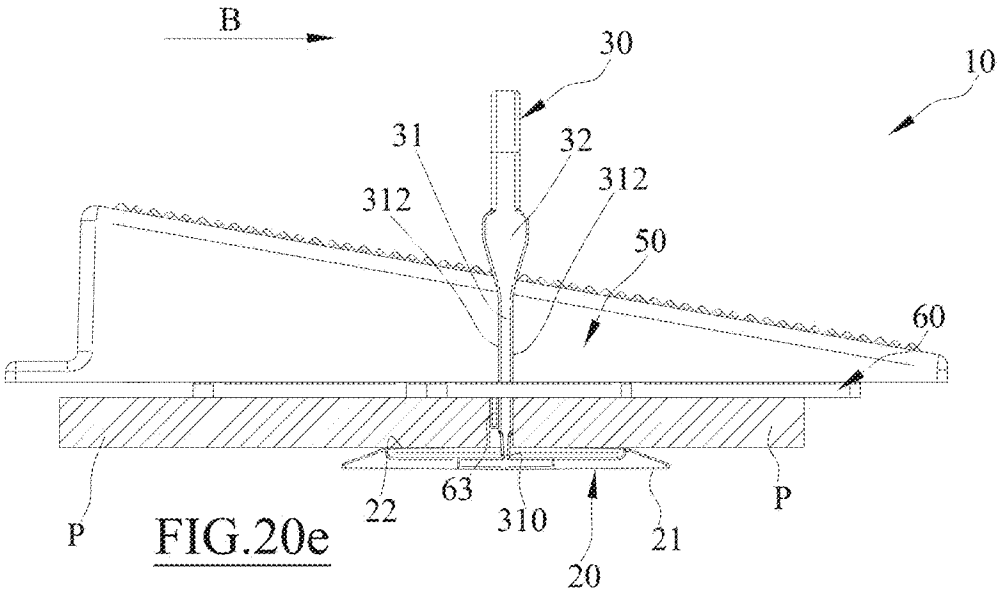

In practice, in the location where the first tile P must be arranged, it is sufficient to position a first device 10, the base 20 of which is intended, for example, to be placed under two edges of respective tiles P, one edge and two corners of three respective tiles P or four corners of four respective tiles P, depending on the desired laying pattern (see FIG. 20*a*).

Once the base 20 has been positioned, it is sufficient to position the tiles P so that a portion of the lateral side P3 of each or one tile P is substantially in contact respectively with a sidewall 312 of one or both legs 31.

In this way the equidistance between the two/three/four tiles P which surround the separator element 30 of the device 10 is assured and they rest on the resting surface of the base 20. When, for example, the tiles P have particularly large dimensions, it is then possible to also position a device 10 at a median area of the lateral side P3 of the tile itself.

The operation generally takes place by first laying a tile P and subsequently inserting a base portion 20 of the device 10 at the corner or sidewall thereof.

In this circumstance, the inclined surfaces 225 (and the elongated shape in a direction orthogonal to the median plane M of the lateral portions of the upper surface 22—lowered with respect to the central portion—and, for example, the slots 23) play an important role in facilitating (together) the wedging of the base 20 below the laying surface of the tile P, allowing in any case the adhesive to not be completely scraped away from the laying surface P1 itself.

Once the various bases 20 have been positioned with the respective separator elements 30 which rise above the surfaces in view of the side-by-side tiles P as described above, until the adhesive has not completely solidified, proceed first by inserting (see FIG. 20*b* and FIG. 20*c*) a plate 60 of the separator element 30 on each portion projecting from the plane defined by the surfaces in view P2 of the tiles P.

In practice, it is sufficient to insert the through opening 62 of the plate 60 with the free end of the separator element 30.

In greater detail, it is necessary to place the plate 60 with the first surface 610 facing the surfaces in view P2 of the tiles P and then insert the separator element 30 into the through opening 62.

In this way, the lamella 63 which protrudes from the first surface towards the base 20 is aligned (spontaneously), along the sliding direction along the separator element 30, with the joint between the tiles P from which the separator element 30 rises itself and parallel to said separator element 30.

In arranging the plate 60 it is necessary to consider the desired direction of crossing B to impose on the pusher element 50, since it is necessary to arrange the plate 60 so that the lamella 63 is located posteriorly to the separator element 30 in the direction of crossing of the same separator element 30 by the pusher element 50.

When the first surface 610 of the plate 60 is brought into contact with the surface in view of one or more tiles P which surround the separator element 30 (see FIG. 20*c*), the lamella 63 is inserted in the apical portion of the joint, in particular in the interspace defined (or which is defined) between a pair of coplanar sidewalls 312 of the separator element 30 and (the apical portion of) the lateral side P3 of the tile(s) P facing therewith.

In this way, the apical portion of the lateral side P3, which connects the surface in view P2 and the lateral side P3, of the tile P is not in direct contact with the separator element 30, but the lamella 63 is interposed between them.

At this point, as long as the adhesive has not yet completely solidified, the various pusher elements 50 are inserted inside each through opening 40 by inserting them from the tapered end 54 (see FIG. 20*d*).

During the advancement of the pusher element 50 in its direction of crossing B in the through window 40, the pusher element 50 gradually presses on the surface in view P2 (through the interposition of the plate 60) of the tiles P, locally at the various points (median or corner), allowing the perfect levelling of the surfaces in view P2 of the tiles P themselves.

The insertion of the pusher element 50 can be effected and facilitated by special gripper devices, as known to those skilled in the art, which in fact exert a compression (symbolised with the arrows F in FIG. 20*f*) between the enlarged end 55 of the pusher element 50 and the face (of the portion rising from the tiles P) of the separator element 30 opposite the face thereof which comprises the sidewalls 312 in contact with the lamella 63.

The plate 60 allows protecting the surface in view P2 of the tiles P from rubbing against the pusher element 50, but further allows protecting the apical portion of the tiles P from the indentation or detachment of the surface in view P2.

Figure 20F:
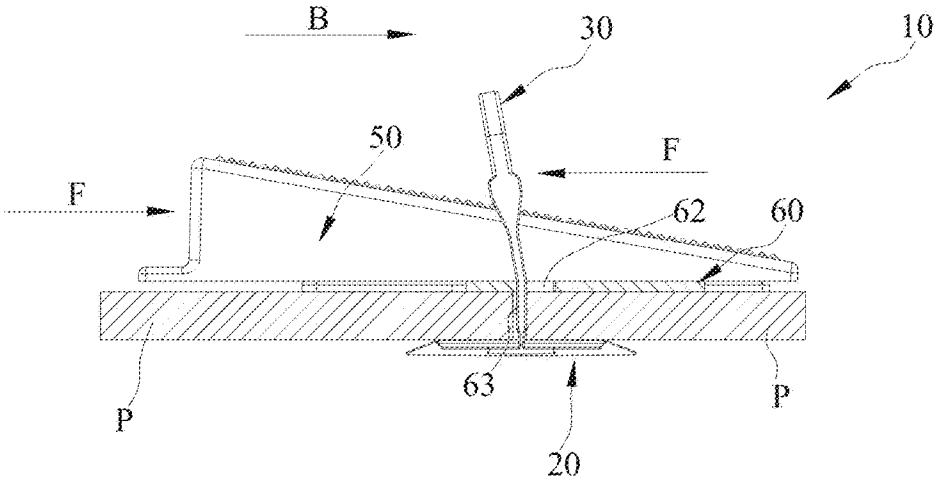
Figure 22:
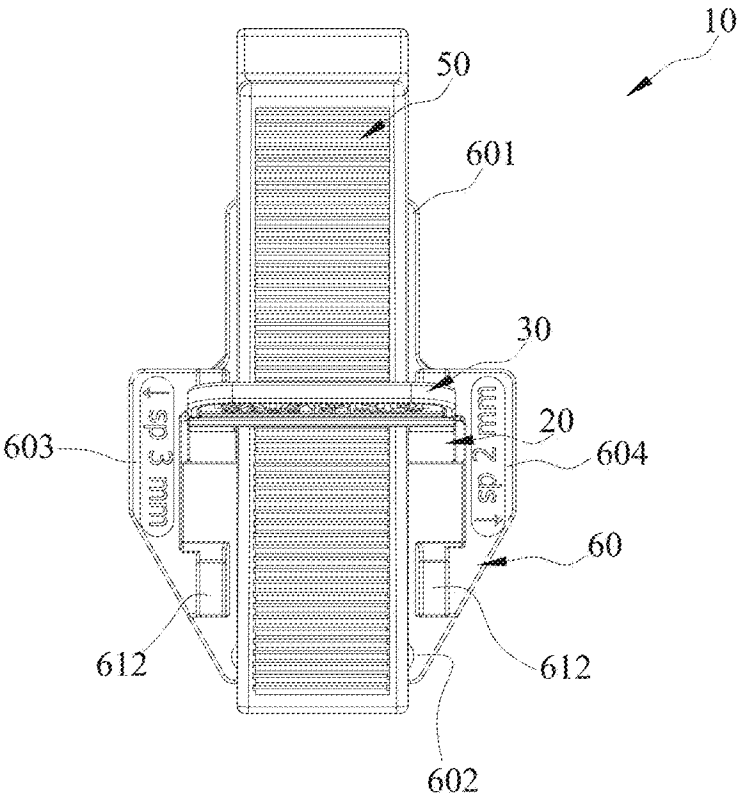
FIG. 22 is a plan view of FIG. 21.
Figure 21:
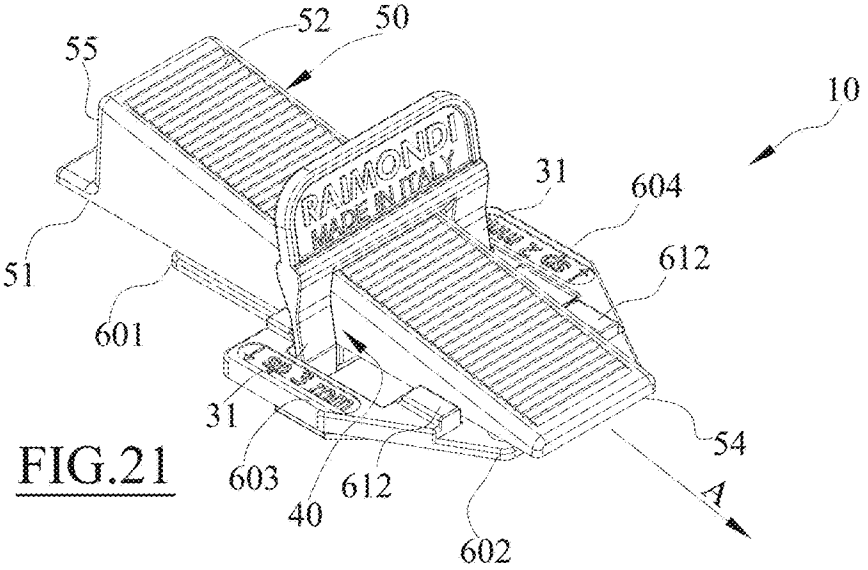
FIG. 21 is an upper axonometric view of a fourth embodiment of the levelling spacer device according to the invention.
Figure 23:
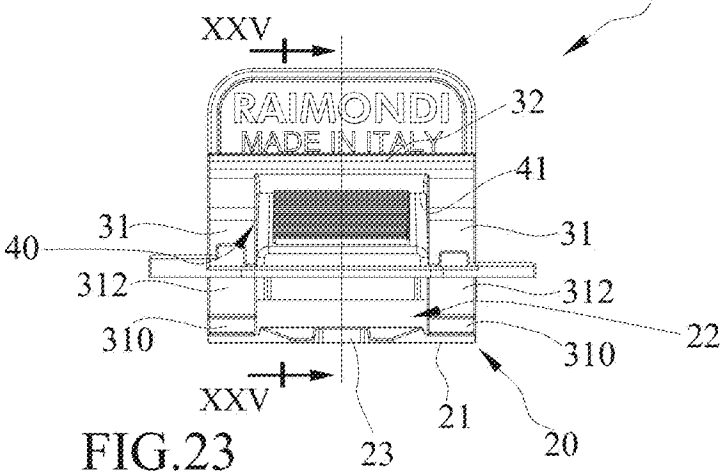
FIG. 23 is a raised front view of FIG. 21.
Figure 25:
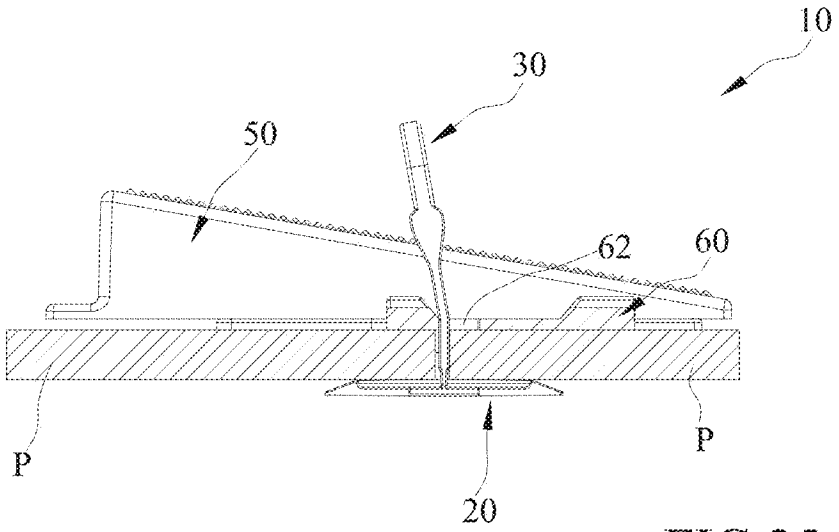
FIG. 25 is a sectional view along the trace of section XXV-XXV of FIG. 23.
Figure 24:
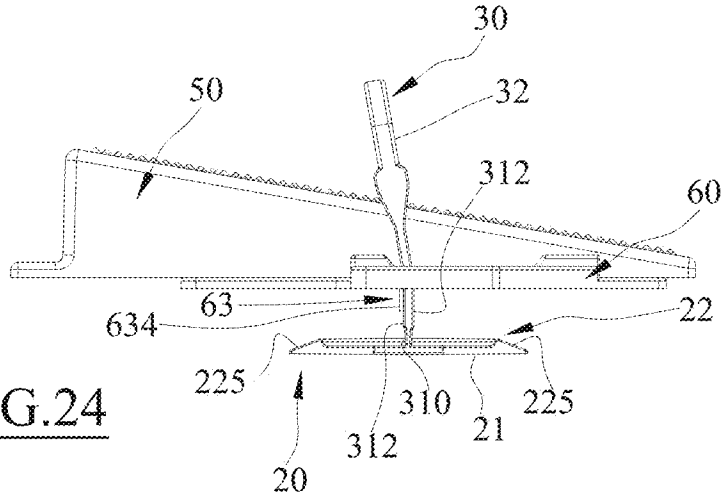
FIG. 24 is a raised side view of FIG. 21.

In fact, as can be seen in FIG. 20*f*, the compression which allows the insertion of the pusher element 50 into the window 40 and the consequent levelling of the surfaces in view P2 of the tiles P is such as to cause—especially in the final stages of insertion—a deformation of the separator element 30, which tends to bend posteriorly with respect to the direction of crossing B imposed on the pusher element 50.

This rear bending, together with the elongation in a distancing direction away from the base 20 caused by the normal component to the base 20 of the traction exerted by the pusher element 50 on the separator element 30, is discharged (instead of on the apical portion of the tiles P, as instead can occur in the known devices) on the lamella 63, which in fact protects this apical portion of the tiles P, avoiding the local detachment or breaking/indenting of the surface in view P2 of the tiles P (especially when the tiles P are glazed).

Finally, when the adhesive has hardened and is in place, the separator element 30 is removed, causing, for example by means of an impulsive force, the triggering of the (fragile) fracture along the fracture line 310 of the separator element 30 from the base 20.

In practice, it is possible to remove the separator element 30 (disposable) and the pusher element 50 (reusable) so as to be able to fill the joints between the tiles P without the base 20 being visible on the finished surface and substantially no part of the base 20 nor the separator element 30 remains interposed between the tiles themselves.

The invention thus conceived is susceptible to several modifications and variations, all falling within the scope of the inventive concept.

Moreover, all the details can be replaced by other technically equivalent elements. In practice, the materials used, as well as the contingent shapes and sizes, can be whatever according to the requirements without for this reason departing from the scope of protection of the following claims.

The invention claimed is:

1. A levelling spacer device for laying sheet-shaped products to cover surfaces, comprising:

a base positionable posteriorly to a laying surface of at least two sheet-shaped products arranged adjacent and side by side relative to a direction parallel to a central longitudinal axis of the base and orthogonal to a median plane of the base;

a separator element which rises perpendicularly from said base and is configured to slip between facing lateral sides of said two sheet-shaped products placed side by side;

a pusher element configured to be inserted into an opening defined in the separator element; and a plate provided with at least one through opening having a longitudinal axis and being configured to be inserted onto the separator element, wherein the plate is configured to be interposed between the pusher element and the base and comprises a first flat surface facing the base wherefrom at least one lamella, having a longitudinal axis parallel to the through opening longitudinal axis, projects, which is sized and configured to slip between a lateral side of one of the two adjacent and side-by-side sheet-shaped products and the separator element, wherein the at least one lamella comprises a first end connected to the plate at an edge of the through opening and an opposite free second end.

2. The device according to claim 1, wherein the at least one lamella comprises a first flat face which is facing towards the separator element and is intended to come into contact with at least one portion of a sidewall of the separator element, and an opposed second flat face which is intended to face the lateral side of a sheet-shaped product facing said sidewall of the separator element.

3. The device according to claim 1, wherein the separator element comprises a through window, a shaped edge of which is intended to be placed at a distance from the base greater than a level of a surface in view of the sheet-shaped products from the base.

4. The device according to claim 3, wherein the pusher element comprises a wedge provided with a longitudinal axis and having a tapered end and an opposite enlarged end, wherein the wedge is configured to be inserted inside the through window on the side of the tapered end and to slide along the side-by-side direction resting on a second surface of the plate opposite the first surface cooperating with said shaped edge for pushing the sheet-shaped products towards the base.

5. The device according to claim 4, wherein the at least one lamella is placed in contact with a sidewall of the separator element, the sidewall facing the enlarged end of the wedge.

6. The device according to claim 1, wherein the separator element exhibits a predetermined fracture line or section configured, in use, to be placed below the level of a surface in view of the sheet-shaped products resting on the base.

7. The device according to claim 1, wherein the plate comprises a plurality of peripheral zones exhibiting calibrated thicknesses different from one another.

8. The device according to claim 1, wherein a thickness of the at least one lamella is smaller than or equal to a thickness of the separator element.

9. The device according to claim 1, wherein a thickness of the at least one lamella is smaller than or equal to a width of the through opening.

10. The device according to claim 1, wherein a length of the at least one lamella is equal to a length of the through opening.

11. A levelling system comprising:

at least two sheet-like products arranged adjacent and side by side relative to a direction parallel to a central longitudinal axis of a base and orthogonal to a median plane of the base, wherein each of the sheet-like products has a laying surface, an in-view opposite surface opposite to the laying surface, and lateral sides connecting the laying surface and the in-view opposite surface; and a levelling spacer device, wherein the levelling spacer device comprises:

a base positionable posteriorly to the laying surface of the at least two sheet-like products;

a separator element which rises orthogonally from said base and configured to slip between the respective lateral sides of said two sheet-like products placed adjacent and side by side with respect to one another;

a pusher element configured to cooperate with the separator element; and a plate provided with at least one through opening configured to be inserted onto the separator element, wherein the plate is configured to be interposed between the pusher element and the in view opposite surface of the at least two sheet-like products resting on the base and comprises a first flat surface facing the base, and wherein the plate comprises at least one lamella projecting from the first flat surface of the plate and configured to slip between a lateral side of a sheet-like product and the separator element in contact therewith.

12. A levelling system comprising:

at least two sheet-like products arranged adjacent and side by side relative to a direction parallel to a central longitudinal axis of a base and orthogonal to a median place of the base, wherein each of the sheet-like products has a laying surface, an in-view opposite surface and lateral sides connecting the laying surface and the in-view opposite surface to one another; and a levelling spacer device, wherein the levelling spacer device comprises:

a base positionable posteriorly to the laying surface of the at least two sheet-like products;

a separator element which rises orthogonally from said base and configured to slip between facing lateral sides of said two sheet-like products placed side by side;

a pusher element configured to cooperate with the separator element; and a plate provided with at least one through opening configured to be inserted onto the separator element, wherein the plate is configured to be interposed between the pusher element and the in view opposite surface of the at least two sheet-like products resting on the base and comprises a first flat surface facing the base, and wherein the plate comprises at least one lamella projecting from the first flat surface of the plate and configured to slip into a gap formed between a lateral side of a sheet-like product and the separator element in contact therewith.

* * * * *